United States Patent [19]

Feasey

[11] Patent Number: 4,490,456

[45] Date of Patent: Dec. 25, 1984

[54] SELF-DEVELOPING PHOTOGRAPHIC FILM UNITS

[75] Inventor: Raymond D. Feasey, Pittsford, N.Y.

[73] Assignee: Eastman Kodak Company, Rochester, N.Y.

[21] Appl. No.: 439,155

[22] Filed: Nov. 4, 1982

[51] Int. Cl.[3] ..... G03C 5/54; G03C 1/90; G03C 1/96; G03D 9/02

[52] U.S. Cl. ..... 430/210; 430/207; 354/304; 156/252; 156/257; 156/254; 156/270

[58] Field of Search ..... 430/207, 210, 208, 497; 354/304; 156/252, 257, 259, 270

[56] References Cited

U.S. PATENT DOCUMENTS

| | | | |
|---|---|---|---|
| 2,495,111 | 1/1950 | Land | 354/84 |
| 2,500,422 | 3/1950 | Land | 430/499 |
| 2,609,296 | 9/1952 | Land | 430/497 |
| 2,669,516 | 2/1954 | Land | 354/84 |

OTHER PUBLICATIONS

*Research Disclosure,* vol. 176, Text No. 17622, Dec. 1978, Industrial Opportunities Ltd. of Homewell, Havant, England.

*Primary Examiner*—Richard L. Schilling
*Attorney, Agent, or Firm*—William C. Dixon

[57] ABSTRACT

Self-developing photographic film units are disclosed having an IIR sheet cut from an elongate web of material, a second sheet cut from an elongate web of material, and a mask sheet cut from an elongate web of material and spacer means between the IIR sheet and the second sheet. The mask sheet and spacer means serve to seal the IIR sheet and the second sheet together along opposite side margins thereof. A container of processing composition and a trap are disposed at opposite end margins of the film unit.

The IIR sheet is strippable between a portion thereof bearing an image after processing and other components of the film unit including a non-image-bearing portion of the IIR sheet overlying the container. Preferably the stripping occurs between photosensitive layers and an image-receiving layer of the IIR sheet. The IIR sheet has a discontinuous slit between the image-bearing portion and the non-image-bearing portion. The discontinuities constrain the two part webs against movement relative to one another after slitting. Such movement may be as a result of differential stretching during heat sealing.

9 Claims, 4 Drawing Figures

SELF-DEVELOPING PHOTOGRAPHIC FILM UNITS

BACKGROUND OF THE INVENTION

1. Field of the Invention

This invention relates to self-developing photographic film units and to the manufacture of such film units.

2. Description of the Prior Art

Self-developing photographic film units are known which include an integral imaging receiver (IIR) sheet and a second sheet, sometimes termed a cover sheet. Between the IIR sheet and the cover sheet are a mask sheet and spacer rails. A container of processing composition and a trap, including a trap spacer, are at opposite margins of the film unit. Such film units are exposed through the cover sheet and the visible image created by processing initiated by spreading processing composition, from the container, throughout the film unit, is viewed from the opposite side, i.e. by looking at the IIR sheet.

Text No. 17622 published in the December 1978 edition of the journal *Research Disclosure,* published by Industrial Opportunities Ltd. of Homewell, Havant, England, describes a self-processing photographic film unit which permits but does not require the removal of expended processing materials. That text describes the provision of a stripping layer in the IIR sheet between the photosensitive layers and the image-receiving layer. In the structure illustrated in and described with reference to FIG. 5 of that text there is a score line (21) which allows an unwanted marginal portion of the receiver sheet to be separated from the wanted image-bearing portion—the unwanted portion remaining with the expended processing materials.

It is known to make film units from continuous webs by a production method which involves the application of heat energy to activate heat activatable adhesives. It was found that if the receiver sheet web is slit into two discrete part webs prior to the heat sealing of the receiver sheet web to the mask web, differential stretching created a problem in the form of an increasingly large loop in one of the part webs between the slitting position and the heat-sealing position. Also there were problems in keeping the two part webs in the desired mutually abutting relationship.

It is an object of the present invention to provide a film unit and a method of production of a film unit in which said problems are overcome.

SUMMARY OF THE INVENTION

Self-developing photographic film units according to the present invention are manufactured of an IIR sheet cut from an elongate web of material, a second sheet cut from an elongate web of material, and a mask sheet cut from an elongate web of material and spacer means between the IIR sheet and the second sheet. The mask sheet and spacer means serve to seal the IIR sheet and the second sheet together along opposite side margins thereof. A container of processing composition and a trap are disposed at opposite end margins of the film unit.

The IIR sheet is strippable between a portion thereof bearing an image after processing and other components of the film unit including a non-image-bearing portion of the IIR sheet overlying the container. Preferably the stripping occurs between photosensitive layers and an image-receiving layer of the IIR sheet. The IIR sheet has a discontinuous slit between the image-bearing portion and the non-image-bearing portion. The discontinuities constrain the two part webs against movement relative to one another after slitting. Such movement may be as a result of differential stretching during heat sealing.

The invention and its objects and advantages, will become more apparent in the detailed description of the preferred embodiments presented below.

BRIEF DESCRIPTION OF THE DRAWINGS

The description of the preferred embodiment refers to the attached drawings wherein.

DESCRIPTION OF THE PREFERRED EMBODIMENT

Figure 1:
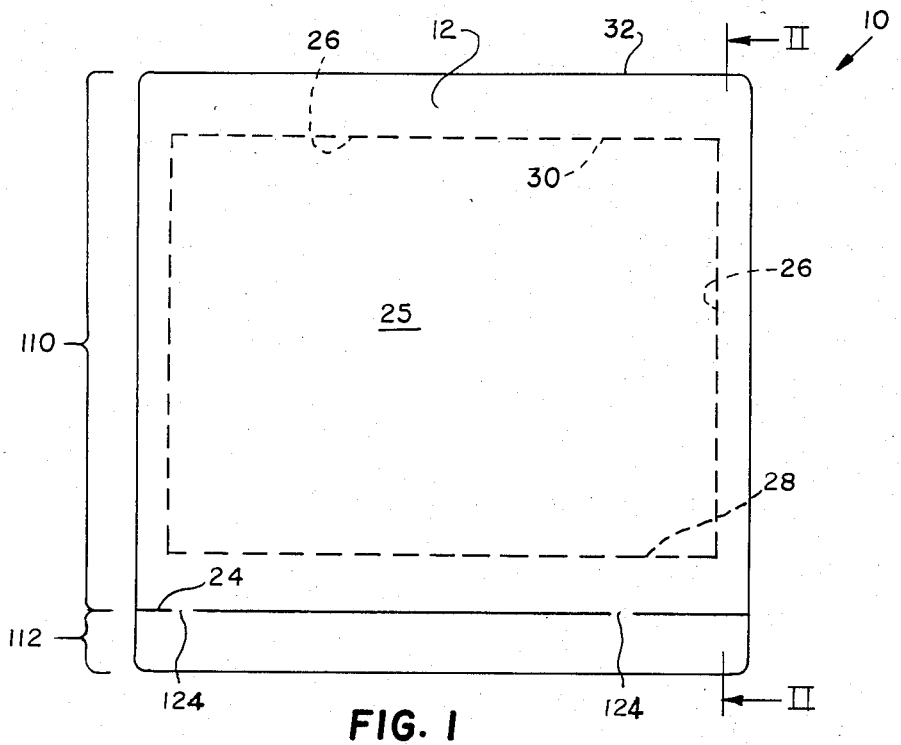
FIG. 1 represents a self-developing photographic film unit embodying the present invention.
Figure 2:
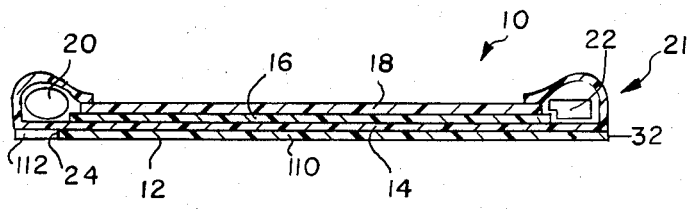
FIG. 2 represents a section on the line II—II in FIG. 1 showing the laminar structure of the film unit.

In FIG. 1 there is illustrated a self-developing photographic film unit 10 similar to that marketed by Eastman Kodak Company under the trademark Kodamatic. The various components of the film unit 10 are illustrated in their combined form in FIG. 2 and comprise an integral imaging receiver (IIR) sheet 12, a mask sheet 14, spacer means such as rails 16, a second or cover sheet 18, a container of processing composition 20 and a trap 21 including a trap spacer 22. The receiver sheet 12, mask sheet 14, spacer rails 16 and cover sheet 18 are sealed together by heat activated adhesive in known manner.

The receiver sheet 12 differs from the receiver sheet of the Kodamatic film units marketed by Kodak in that the opaque layer is formed as two part layers and a stripping layer is provided between the two opaque part layers.

In FIG. 1 the image area 25 is represented by a boundary 26 which is an aperture in the mask sheet 14. The film unit differs from the presently commercially available Kodak film units in that the receiver sheet 12 has a discontinuous slit 24 extending completely through its thickness. The slit 24 overlies the container 20 and is completely covered by the mask sheet which is sealed to the IIR sheet 12 at both sides of the slit. The slit is spaced from the adjacent edge 28 of the image area, as defined by the boundary 26, a distance equal to the distance of the opposite edge 30 of the image area 25 from its adjacent edge 32 of the film unit.

Figures 3, 4:
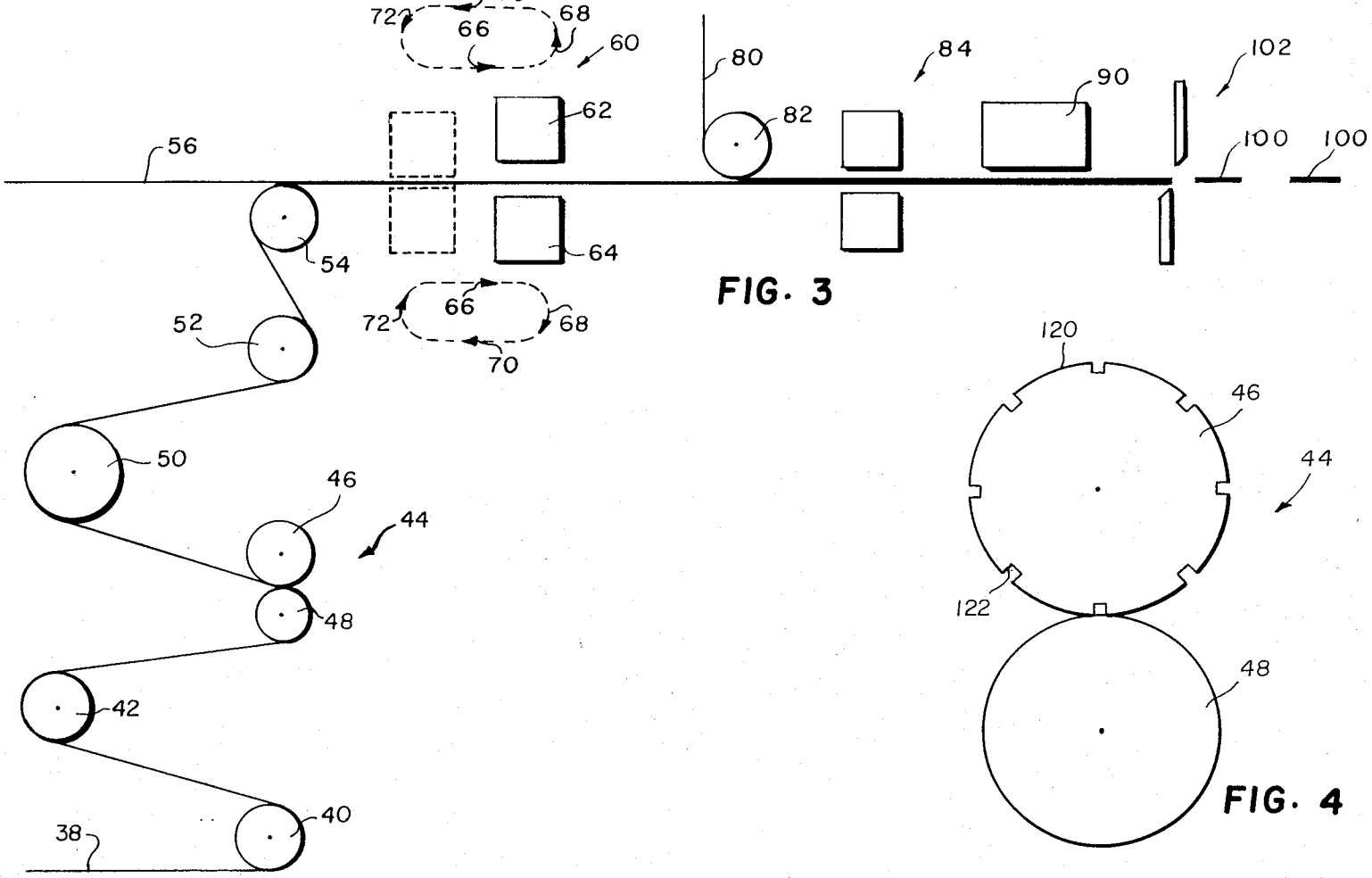
FIG. 3 is a diagrammatic representation of apparatus for producing the film unit represented in FIGS. 1 and 2.
FIG. 4 represents slitter knives (on an enlarged scale) included in the apparatus represented in FIG. 3.

Such film units are manufactured from continuous webs by a continuous movement method, the apparatus for which is illustrated in FIG. 3. A web 38 of receiver sheet material is led from a supply reel (not shown) around idler rollers 40, 42 to a slitter 44. The slitter comprises an upper knife 46 and a bed knife 48 and creates the discontinuous slit 24. From the slitter 44 the web 38 goes to a tension controlling drum 50 and from there around an idler roller 52 to a further roller 54 at which it is brought into mating relation with a web 56 of mask sheet material.

The mask sheet material web 56 and the discontinuously slit web 38 move together in unison to a heat sealer 60 which activates the heat activated adhesive on the mask sheet web 56 to cause bonding of the two webs 38, 56. The sealer 60 includes jaws heated by resistance heaters and its upper and lower components 62, 64 are caused to move over oblong paths including an operative, heating run 66 in which the webs are gripped and the components 62, 64 move at the same speed and in the same direction as the webs, and a parting run 68, a return run 70 and an approaching run 72.

The united webs 38, 56 move on continuously and a cover sheet material web 80 with spacer rails secured thereto is mated with the united webs 38, 56 at roller 82. The cover sheet web 80 is sealed to the united webs 38, 55 by a heat sealer 84 similar to the sealer 60. The three united webs 38, 56, 80 move on to a location 90 at which containers 20 and trap spacers 22 are applied to laterally outwardly projecting margins of the mask sheet web 56. The mask sheet web margins with containers 20 and trap spacers 22 are folded inwards in known fashion and heat sealed to the cover sheet web 80. Individual film units 100 are severed from the web by a cutter 102 and are inserted in a cartridge housing with a dark slide.

During the operative, heating run 66 of the sealer components 62, 64, heat is conducted along the slit web 38 in the direction opposite to its movement. During the return runs 70 of the components 62, 64 heat is radiated from them to the slit web 38. Thus, before the web 38 is sealed to the mask sheet web 56 it receives heat energy by conduction and radiation. The densities of the energy applied at this time to the parts 110, 112 of the web 38 at opposite sides of the slit 24 differ, that to the narrower part web being greater. The mask sheet 14 has image apertures therein so there is no heat sealing to be effected in the actual image areas, therefore the image areas may be regarded as heat sinks which do not rise to as high temperature as the areas to be heat sealed and which tend to lower temperatures of the heated areas adjacent thereto. Also the part web 110 which is to include the image is much wider than the part web 112 which will not include the image. Because of these differences the two part webs 110, 112 have different tendencies to stretch under the influence of the heat reaching them before they are sealed to the mask web 56.

However, because of the discontinuities, termed bridges 124, the differential stretching is prevented. If the bridges 124 were not present, the part web 112 would stretch more than the part web 110 and over a period of operation a loop would build up in the part web 112 between the tension controlling drum 50 and the idler roller 52 which would be unsatisfactory. The bridges 124 prevent such a problem.

The bridges 124 also serve to keep the two part webs 110, 112 butted together, which renders unnecessary special guidance means to ensure such butting relationship at the time of sealing at the sealer 60. Thus, the bridges constrain the two part webs against movement relative to one another both laterally and longitudinally.

The slit 24 is made by the slitter 44, the knives 46, 48 of which are shown in greater detail in FIG. 4. The knife 46 has a circular cutting edge 120 which has notches 122 uniformly angularly disposed at 45° angles to one another. The knife 46 has a diameter of about 5½" so that the notches are spaced at about 2¼" arc length apart. In this way the bridges 120 are spaced apart about 2¼" and hence there may be two bridges in some film units.

The overlap of the knives 46, 48 is held to such a small value that climbing of the knife 46 onto the periphery of the knife 48 as a notch 122 comes into register with knife 48 is avoided.

The stripping layer in the receiver sheet 12 allows the support and image-receiving layer of the receiver sheet to be stripped away from the mask sheet, spacer rails, cover sheet, container and trap spacer, as well as the photosensitive and dye-producing layers of the receiver sheet. The slit 24 allows the image bearing portion of the stripped receiver sheet to leave behind at the time of stripping the portion 112 of the receiver sheet. In this way the borders at the "top" and "bottom" of the image (i.e. adjacent edges 28 and 30) may have the same width. The borders at the two sides inherently have the same width. Such a film unit has the advantage of less thickness and bulk than one which is not strippable in the above described manner, and is aesthetically preferable because of the equal top and bottom borders.

The invention has been described in detail with particular reference to a certain preferred embodiment thereof, but it will be understood that variations and modifications can be effected within the spirit and scope of the invention.

I claim:

1. A method of manufacturing self-developing photographic film units, each such film unit including (1) an IIR sheet cut from an elongate web of material, (2) a second sheet cut from an elongate web of material, (3) a mask sheet cut from an elongate web of material and spacer means between the IIR sheet and the second sheet and serving to seal the IIR sheet and the second sheet together along opposite side margins thereof, (4) a container of processing composition, and (5) a trap having a trap spacer, the container and trap being disposed at opposite end margins of the film unit, the IIR sheet having a support, an image-receiving layer, and other layers, the IIR sheet being strippable between a portion thereof including its support and image-receiving layer bearing an image after processing and other components of the film unit including said other layers and a non-image-bearing portion of the IIR sheet overlying the container, the IIR sheet having a discontinuous slit between the image-bearing portion and the non-image-bearing portion, said method including the steps of:

(a) longitudinally slitting the IIR web into two part webs of unequal widths, the slit being discontinuous whereby the two part webs are constrained against movement relative to one another after slitting;

(b) adding containers and trap spacers at opposite margins of the IIR web; and (c) sealing together the webs of IIR sheet material, second sheet material, and mask sheet material and the spacer means, to form a composite web of all three sheet materials and spacer means, said sealing comprising (i) that sealing the web of mask sheet material to the web of IIR sheet material to form a composite web of mask sheet and IIR sheet materials, (ii) heat sealing the spacer means to the web of second sheet material to form a composite web of spacer means and second sheet material, and (iii) heat sealing the composite web of mask sheet and IIR sheet materials to the composite web of spacer means and second sheet material to form the composite web of all three sheet materials and spacer means.

2. The method set forth in claim 1 wherein said adding step sequentially follows said sealing step.

3. The method set forth in claim 1 further including the step of cutting completed film units from the composite web of all three sheet materials and spacer means.

4. A method of manufacturing self-developing photographic film units, each such film unit including (1) an IIR sheet cut from an elongate web of material including photosensitive layers and an image-receiving layer, (2) a second sheet cut from an elongate web of material, (3) a mask sheet cut from an elongate web of material and spacer means between the IIR sheet and the second sheet and serving to seal the IIR sheet and the second sheet together along opposite side margins thereof, (4) a container of processing composition, and (5) a trap including a trap spacer, the container and trap being disposed at opposite end margins of the film unit, the IIR sheet being strippable between the photosensitive layers and the image-receiving layer, the IIR sheet having a discontinuous slit between an image-bearing portion and a non-image-bearing portion thereof, said method including the steps of:

(a) longitudinally slitting the IIR web into two part webs of unequal widths, the slit being discontinuous whereby the two part webs are constrained against movement relative to one another after slitting;

(b) adding containers and trap spacers at opposite margins of the IIR web; and (c) sealing together the web of IIR sheet material, the web of second sheet material, the web of mask sheet material, and the spacer means, to form a composite web of all three sheet materials and spacer means, said sealing comprising (i) heat sealing the web of mask sheet material to the web of IIR sheet material to form a composite web of mask sheet and IIR sheet materials, (ii) heat sealing the spacer means to the web of second sheet material to form a composite web of spacer means and second sheet material, and (iii) heat sealing the composite web of mask sheet and IIR sheet materials to the composite web of spacer means and second sheet material to form the composite web of all three sheet materials and spacer means.

5. A method of manufacturing self-developing photographic film units, each such film unit including (1) an IIR sheet cut from an elongate web of material, (2) a second sheet cut from an elongate web of material, (3) a mask sheet cut from an elongate web of material and spacer means between the IIR sheet and the second sheet and serving to seal the IIR sheet and the second sheet together along opposite side margins thereof, (4) a container of processing composition, and (5) a trap including a trap spacer, the container and trap being disposed at opposite end margins of the film unit, the IIR sheet having a support, an image-receiving layer, and other layers, the IIR sheet being strippable between a portion thereof including its support and image-receiving layer bearing an image after processing and other components of the film unit including said other layers and a non-image-bearing portion of the IIR sheet overlying the container, the IIR sheet having a discontinuous slit between the image-bearing portion and the non-image-bearing portion, said method including the steps of:

(a) longitudinally slitting the IIR web into two part webs of unequal widths, the slit being discontinuous whereby the two part webs are constrained against differential stretching under influence of heat after slitting;

(b) adding containers and trap spacers at opposite margins of the IIR web; and (c) sealing together the web of IIR sheet material, the web of second sheet material, the web of mask sheet material, and the spacer means, to form a composite web of all three sheet materials and spacer means, said sealing comprising (i) heat sealing the web of mask sheet material to the web of IIR sheet material to form a composite web of mask sheet and IIR sheet materials, (ii) heat sealing the spacer means to the web of second sheet material to form a composite web of spacer means and second sheet material, and (iii) heat sealing the composite web of mask sheet and IIR sheet materials to the composite web of spacer means and second sheet material to form the composite web of all three sheet materials and spacer means.

6. A self-developing photographic film unit comprising:

(a) an IIR sheet having within its thickness a support, an image-receiving layer, a stripping layer, and other layers;

(b) a second sheet generally coextensive with said IIR sheet;

(c) a mask sheet and spacer means disposed between said IIR sheet and said second sheet and joining said IIR sheet and said second sheet together along opposite lateral margins of said film unit, said mask sheet defining an image portion of said IIR sheet;

(d) a container of processing composition and a trap at opposed end margins of said film unit; and (e) a slit cut through said thickness of said IIR sheet along one of said end margins to and through both of said lateral margins and lying between said image portion and a non-image portion of said IIR sheet, said slit being discontinuous to form an interrupted tear line;

(f) said image portion being separable from said non-image portion at said tear line, and said support and said image-receiving layer together being separable from said other layers at said stripping layer, to render said support and image-receiving layer in said image portion optionally removable from other components of said film unit.

7. The film unit set forth in claim 6 wherein said container is at said one of said end margins and extends therealong substantially parallel with said slit in underlying relationship to said non-image portion.

8. The film unit set forth in claim 7 wherein said mask sheet extends between said container and said non-image portion and is sealed to said IIR sheet at both sides of said slit.

9. The film unit set forth in claim 8 wherein said other components thereof include said other layers in said image portion, said non-image portion, said mask sheet, said spacer means, said second sheet, said container, and said trap.

* * * * *